US005705462A

United States Patent [19]

Hormes et al.

[11] Patent Number: 5,705,462

[45] Date of Patent: Jan. 6, 1998

[54] BAR SOAPS CONTAINING ETHER SULFATES AND OLIGOGLYCOSIDES

[75] Inventors: Marlene Hormes; Werner Schneider; Wolfhard Scholz; Udo Hennen, all of Krefeld, Germany

[73] Assignee: Henkel Kommanditgesellschaft auf Aktien, Duesseldorf, Germany

[21] Appl. No.: 635,941

[22] PCT Filed: Oct. 20, 1994

[86] PCT No.: PCT/EP94/03454

§ 371 Date: Apr. 26, 1996

§ 102(e) Date: Apr. 26, 1996

[87] PCT Pub. No.: WO95/11959

PCT Pub. Date: May 4, 1995

[30] Foreign Application Priority Data

Oct. 29, 1993 [DE] Germany ..... 43 37 031.4

[51] Int. Cl.[6] ..... C11D 9/26; C11D 10/04; C11D 17/00

[52] U.S. Cl. ..... 510/141; 510/151; 510/152; 510/153; 510/155; 510/440; 510/447; 510/450; 510/470; 510/472; 510/481; 510/484; 510/485; 510/491; 510/495; 252/367.1

[58] Field of Search ..... 510/141, 151, 510/152, 153, 155, 440, 447, 450, 470, 472, 481, 484, 485, 491, 495; 252/367.1

[56] References Cited

U.S. PATENT DOCUMENTS

| | | | |
|---|---|---|---|
| 4,536,318 | 8/1985 | Cook et al. | 252/174.17 |
| 4,599,188 | 7/1986 | Llenado | 252/174.17 |
| 4,874,538 | 10/1989 | Dawson et al. | 510/147 |
| 5,043,091 | 8/1991 | Joshi et al. | 252/174.17 |
| 5,064,555 | 11/1991 | Medcalf, Jr. et al. | 510/151 |
| 5,202,048 | 4/1993 | Bartold et al. | 510/151 |
| 5,264,144 | 11/1993 | Moroney et al. | 510/151 |
| 5,296,159 | 3/1994 | Wilson et al. | 510/418 |
| 5,340,492 | 8/1994 | Kacher et al. | 510/146 |
| 5,374,716 | 12/1994 | Biermann et al. | 536/18.6 |
| 5,487,843 | 1/1996 | Coyle et al. | 510/535 |
| 5,500,155 | 3/1996 | Weuthen et al. | 510/130 |
| 5,540,852 | 7/1996 | Kefauver et al. | 510/152 |
| 5,607,909 | 3/1997 | Kefauver et al. | 510/152 |

FOREIGN PATENT DOCUMENTS

| | | |
|---|---|---|
| 070074 | 1/1983 | European Pat. Off. . |
| 176330 | 4/1986 | European Pat. Off. . |
| 189332 | 7/1986 | European Pat. Off. . |
| 075994 | 1/1987 | European Pat. Off. . |
| 222525 | 5/1987 | European Pat. Off. . |
| 227321 | 7/1987 | European Pat. Off. . |
| 301298 | 2/1989 | European Pat. Off. . |
| 308189 | 3/1989 | European Pat. Off. . |
| 308190 | 3/1989 | European Pat. Off. . |
| 463912 | 1/1992 | European Pat. Off. . |
| 472320 | 2/1992 | European Pat. Off. . |
| 508006 | 10/1992 | European Pat. Off. . |
| 593422 | 2/1934 | Germany . |
| 3250100 | 11/1991 | Japan . |
| 4213398 | 8/1992 | Japan . |
| WO9003977 | 4/1990 | WIPO . |

OTHER PUBLICATIONS

Hollstein et al., "Manufacture and Properties of Synthetic Toilet Soaps", J. Am. Oil Chem. vol. 59, No. 10, Oct. 1982, pp. 442–448.

*Primary Examiner*—Douglas J. McGinty
*Assistant Examiner*—Lorna M. Douyon
*Attorney, Agent, or Firm*—Wayne C. Jaeschke; John E. Drach; Henry E. Millson, Jr.

[57] ABSTRACT

A bar soap comprising:

A) from about 70 to about 85% by weight of at least one fatty acid salt,

B) from about 0.5 to about 10% by weight of at least one fatty acid,

C) from about 1 to about 10% by weight of at least one alkyl ether sulfate, and

D) from about 0.1 to about 1% by weight of at least one of an alkyl oligoglycoside and an alkenyl oligoglycoside.

20 Claims, No Drawings

BAR SOAPS CONTAINING ETHER SULFATES AND OLIGOGLYCOSIDES

BACKGROUND OF THE INVENTION

1. Field of the Invention

This invention relates to bar soaps containing fatty acid salts, fatty acids, alkyl ether sulfates, alkyl and/or alkenyl oligoglycosides and optionally other auxiliaries and additives.

2. Statement of the Related Art

Modern bar soaps, more particularly toilet soaps, are normally based on mixtures of beef tallow and coconut oil in a ratio of approximately 8:2. This fatty mixture is hydrolyzed by addition of sodium hydroxide to the base soap to which other additives, including for example humectants, fillers and binders, superfatting agents, dyes and perfumes, etc., are added. Toilet soaps normally contain around 80% of fatty acid salts, 10% of water and ad 100% auxiliaries and additives. The large number of products offered to the consumer reflect the vigorous market interest and, at the same time, make it clear that there is a constant demand among consumers for further improved products distinguished in particular by improved dermatological compatibility, greater foaming power, greater creaminess, refatting, removability by rinsing, feeling on the skin and the like. By contrast, soap manufacturers are looking for soap formulations which, for example, lead to bars of greater breaking strength or which enable certain surfactants, for example alkyl sulfates, to be readily incorporated. An overview on this subject can be found, for example, in J. Am. Oil. Chem. Soc. 59, 442 (1982).

So far as the production of bar soaps is concerned, it is readily possible to look back over a very large number of known processes. A clear distinction has to be made in this regard between synthetic "soap-free" soaps, so-called syndets, and in particular combinations of fatty acid salts and synthetic surfactants ("combination bars"). According to EP-A 0 176 330 (Unilever), for example, combination bars are produced by combining fatty acid soaps with salts of isethionic acid. The use of fatty acid isethionates as a synthetic ingredient of combination bars is known from EP-A 0 189 332, EP-A 0 472 320 and EP-A 0 508 006 (Unilever).

Recently, increasing interest has also been shown in alkyl glucosides as a class of nonionic mild surfactants for the production of toilet soaps. For example, it is proposed in a technical bulletin published by Rohm & Haas on "Triton CG-110" to add this $C_{8-10}$ alkyl oligoglucoside to a base soap in quantities of 2% by weight. It is known from DE-AS 593 422 (Th. Boehme) that the addition of 10 to 15% by weight of acetyl maltoside to a base soap mixture produces an improvement in washing power.

U.S. Pat. No. 4,536,318 and 4,599,188 (Procter & Gamble) describe foaming mixtures of alkyl glucosides and soaps which are described as being basically suitable for the production of bar soaps. In addition, toilet soaps containing cationic polymers in addition to soaps and alkyl glucosides are known from European patent applications EP-A 0 227 321, EP-A 0 308 189 and EP-A 308 190 (Procter & Gamble).

According to the teaching of U.S. Pat. No. 5,043,091 (Colgate), the addition of alkyl glucosides to soaps containing alkyl benzenesulfonates and alkyl sulfates can improve their mechanical properties at the production stage.

European patent application EP-A 0 463 912 (Colgate) describes toilet soaps containing 45 to 95% by weight of $C_{8-24}$ fatty acid soaps, 1 to 20% by weight of alkyl glucosides, humectants and optionally anionic surfactants and/or fatty acids. However, this document specifically recommends using alkyl glucosides in quantities well above 1.5% by weight. In addition, although alkyl ether sulfates are mentioned as possible anionic so-surfactants, the Examples only disclose combinations of fatty acids, soaps and alkyl glucosides.

Despite the extensive prior art, the known solutions are still not entirely satisfactory. More particularly, the processability of the soap (smoothness, colour stability on exposure to high temperatures), the creaminess of the lather and its resistance to water hardness are still unsatisfactory.

Accordingly, the problem addressed by the present invention was to provide new bar soap formulations having a complex property profile which would be free from the disadvantages mentioned above.

DESCRIPTION OF THE INVENTION

The present invention relates to bar soaps containing a) 70 to 85% by weight of fatty acid salts, b) 0.5 to 10% by weight of fatty acids, c) 1 to 10% by weight of alkyl ether sulfates, d) 0.1 to 1% by weight of alkyl and/or alkenyl oligoglycosides and optionally other auxiliaries and additives.

In a preferred embodiment of the invention, the bar soaps may contain a) 73 to 80% by weight of fatty acid salts, b) 2 to 6% by weight of fatty acids, c) 2 to 4% by weight of alkyl ether sulfates, d) 0.5 to 1% by weight of alkyl and/or alkenyl oligoglycosides and optionally other auxiliaries and additives.

It has surprisingly been found that the addition of defined quantities of 0.1 to 1% by weight of alkyl and/or alkenyl oligoglycosides significantly improves the creaminess and hard water resistance and also the lime soap dispersion capacity of commercial combination bars based on soaps and alkyl ether sulfates. In addition, the bar soaps according to the invention have improved colour stabilization during production and are distinguished by a particularly smooth surface after mechanical moulding. The invention also includes the observation that the use of more than about 1% by weight of alkyl and/or alkenyl oligoglycosides leads to a sudden deterioration in the complex property profile. In addition, the positive effect observed is closely related to the alkyl ether sulfate used and cannot readily be applied to other anionic base surfactants, such as for example alkyl sulfates or ester sulfonates.

Fatty Acid Salts and Fatty Acids

The fatty acid salts are soaps which correspond to formula (I):

$$R^1CO—ONa \quad (I)$$

in which $R^1CO$ is an aliphatic acyl radical containing 6 to 22 carbon atoms. Typical examples are the sodium salts of caproic acid, caprylic acid, capric acid, lauric acid, myristic acid, palmitic acid, palmitoleic acid, stearic acid, isostearic acid, oleic acid, elaidic acid, petroselic acid, linoleic acid, linolenic acid, elaeostearic acid, arachic acid, gadoleic acid, behenic acid and erucic acid and technical mixtures thereof such as are formed, for example, in the pressure hydrolysis of natural fats and oils. Technical soap mixtures based on $C_{12-18}$ coconut oil fatty acid, $C_{12-14}$ coconut oil fatty acid and/or $C_{16-18}$ tallow fatty acid are particularly preferred.

Suitable fatty acids are aliphatic carboxylic acids corresponding to formula (II):

$$R^2CO—OH \quad (II)$$

in which $R^2CO$ is an aliphatic acyl radical containing 6 to 22 carbon atoms. Typical examples are caproic acid, caprylic acid, capric acid, lauric acid, myristic acid, palmitic acid, palmitoleic acid, stearic acid, isostearic acid, oleic acid, elaidic acid, petroselic acid, linoleic acid, linolenic acid, elaeostearic acid, arachic acid, gadoleic acid, behenic acid and erucic acid and the technical mixtures thereof formed, for example, in the pressure hydrolysis of natural fats and oils. Technical mixtures based on $C_{12-18}$ coconut oil fatty acid, $C_{12-14}$ coconut oil fatty acid and/or $C_{16-18}$ tallow fatty acid are particularly preferred.

Alkyl Ether Sulfates

The alkyl ether sulfates suitable for use in accordance with the invention are sulfates of ethoxylated alcohols which correspond to formula (III):

$$R^3O—(CH_2CH_2O)_nH \quad (III)$$

in which $R^3$ is a linear or branched alkyl and/or alkenyl radical containing 6 to 22 carbon atoms and n is a number of 1 to 10. They are known addition products of ethylene oxide with fatty alcohols or oxoalcohols which have a conventional or narrow homolog distribution. Typical examples are adducts of 1 to 5 moles of ethylene oxide with 1 mole of $C_{12/14}$ or $C_{12/18}$ coconut oil fatty alcohol.

Alkyl and/or Alkenyl Oligoglycosides

Alkyl and alkenyl oligoglycosides are known substances which may be obtained by relevant methods of preparative organic chemistry and which correspond to formula (IV):

$$R^4O—(G)_p \quad (IV)$$

in which $R^4$ is a linear or branched alkyl and/or alkenyl radical containing 6 to 22 carbon atoms, G is a sugar unit containing 5 or 6 carbon atoms and p is a number of 1 to 10.

EP-A1-0 301 298 and WO 90/3977 are cited as representative of the extensive literature available on the subject. The alkyl and/or alkenyl oligoglycosides may be derived from aldoses or ketoses containing 5 or 6 carbon atoms, preferably glucose. Accordingly, the preferred alkyl and/or alkenyl oligoglycosides are alkyl and/or alkenyl oligoglucosides.

The index p in general formula (IV) indicates the degree of oligomerization (DP degree), i.e. the distribution of mono- and oligoglycosides, and is a number of 1 to 10. Whereas p in a given compound must always be an integer and, above all, may assume a value of 1 to 6, the value p for a certain alkyl oligoglycoside is an analytically determined calculated quantity which is generally a broken number. Alkyl and/or alkenyl oligoglycosides having an average degree of oligomerization p of 1.1 to 3.0 are preferably used. Alkyl and/or alkenyl oligoglycosides having a degree of oligomerization below 1.7 and, more particularly, between 1.2 and 1.4 are preferred from the applicational point of view.

The alkyl or alkenyl radical $R^4$ may be derived from primary alcohols containing 6 to 11 and preferably 8 to 10 carbon atoms. Typical examples are caproic alcohol, caprylic alcohol, capric alcohol and undecyl alcohol and the technical mixtures thereof obtained, for example, in the hydrogenation of technical fatty acid methyl esters or in the hydrogenation of aldehydes from Roelen's oxo synthesis. Alkyl oligoglucosides having a chain length of $C_8$ to $C_{10}$ (DP=1 to 3), which are obtained as first runnings in the separation of technical $C_{8-18}$ coconut oil fatty alcohol by distillation and which may contain less than 6% by weight $C_{12}$ alcohol as an impurity, and alkyl oligoglucosides based on technical $C_{9-11}$ oxoalcohols (DP=1 to 3) are preferred.

In addition, the alkyl or alkenyl radical $R^4$ may also be derived from primary alcohols containing 12 to 22 and preferably 12 to 14 carbon atoms. Typical examples are lauryl alcohol, myristyl alcohol, cetyl alcohol, palmitoleyl alcohol, stearyl alcohol, isostearyl alcohol, oleyl alcohol, elaidyl alcohol, petroselinyl alcohol, arachyl alcohol, gadoleyl alcohol, behenyl alcohol, erucyl alcohol and technical mixtures thereof which may be obtained as described above. Alkyl oligoglucosides based on hydrogenated $C_{12/14}$ coconut oil fatty alcohol having a DP of 1 to 3 are preferred.

Auxiliaries and Additives

The bar soaps according to the invention may contain builders, for example, as additives. Suitable builders are inter alia fine-particle, water-insoluble alkali metal alumosilicates, the use of synthetic crystalline sodium alumosilicates containing bound water being preferred and the use of zeolite A being particularly preferred. Zeolite NaX and mixtures thereof with zeolite NaA may also be used. Suitable zeolites have a calcium binding capacity of 100 to 200 mg CaO/g. A zeolite NaA containing approximately 20% of bound water commercially obtainable as WESSALITH® P (Degussa) is preferably used in a quantity of 8 to 15% by weight.

Suitable plasticizers or binders are glycerol, $C_{12-22}$ fatty alcohols, fatty acid glycerides of $C_{12-22}$ fatty acids or corresponding wax esters.

Other constituents of the formulation may be nonionic surfactants, for example polyglycol ethers having HLB values of 12 to 18 and/or protein fatty acid condensates. Protein fatty acid condensates have long been commercially obtainable, for example, under the names of LAMEPON® and MAYPON®. It has also proved to be of particular advantage to add w/o emulsifiers from the group of pentaerythritol difatty acid esters and citric acid difatty acid esters. The formulations may also contain white pigments (for example BAYERTITAN® ), dyes, fragrances and preservatives (for example IRGASAN® DP 300, FEESOL®, GRILLOCIN® CW 90). Finally, the bar soaps according to the invention may also contain small quantities of water.

The auxiliaries and additives may be used in total quantities of 1 to 5% by weight and preferably in total quantities of 2 to 3% by weight, based on the bar soaps.

Production of the Bar Soaps

The bar soaps according to the invention may be produced by the methods normally used for such products. More particularly, the combination according to the invention of soap with alkyl ether sulfates and alkyl oligoglucosides gives a particularly easy-to-mould material which is plastic when hot and hard when cold, the moulded products having a smooth surface. Conventional processes for mixing or homogenizing, kneading, optionally milling, extruding, optionally pelleting, extruding, cutting and bar pressing are known to the expert and may be used for the production of the bar soaps according to the invention. The bar soaps are normally produced at temperatures in the range from 60° to 90° C., the meltable starting materials being introduced into a heatable kneader or mixer and the non-melting components then being stirred in. The mixture obtained may then be passed through a sieve for homogenization before it is subsequently moulded.

Commercial Applications

The bar soaps according to the invention have a smooth surface and are distinguished by particularly high foaming power, good foam stability, creaminess, lime soap dispersion capacity and excellent skin-cosmetic compatibility. The bar soaps are extremely colour-stable during their production.

EXAMPLES

I. Formulations

TABLE 1

| Component | F1 % | F2 % | F3 % | F4 % | F5 % | F6 % |
|---|---|---|---|---|---|---|
| | Soap formulations | | | | | |
| Soap base | 94.0 | 94.5 | 94.0 | 94.0 | 94.0 | 94.0 |
| Ether sulfate | 3.5 | 3.5 | 3.5 | 3.5 | — | — |
| Alkyl sulfate | — | — | — | — | 3.5 | — |
| Ester sulfonate | — | — | — | — | — | 3.5 |
| Alkyl glucoside | 0.5 | 1.0 | 1.5 | 2.0 | 1.0 | 1.0 |

a) Soap base: 47% by weight of $C_{16/18}$ tallow fatty acid sodium salt, 31% by weight of $C_{12/18}$ coconut oil fatty acid sodium salt, 5% by weight of $C_{12/18}$ coconut oil fatty acid, 1% by weight of glycerol, ad 100% by weight typical additives and water;

b) Ether sulfate: $C_{12/14}$ coconut oil fatty alcohol 3.6 EO sodium salt [Texapon® K14S (70% by weight), Henkel KGaA, Düsseldorf, FRG];

c) Alkyl sulfate: lauryl sulfate sodium salt;

d) Ester sulfonate: α-sulfonated coconut oil fatty acid methyl ester sodium salt;

e) Alkyl glucoside: $C_{8/16}$ coconut oil alkyl oligoglucoside, DP=1.4 [Plantaren® APG 2000 CS-UP, Henkel KGaA, Düsseldorf, FRG]

Formulations 1 and 2 correspond to the invention, formulations 3 to 6 are intended for comparison. Auxiliaries (perfume oil, dyes and preservatives) ad 100% by weight. All percentages are % by weight.

II. Evaluation of the Formulations a) Surface smoothness of the bar soaps
I=very smooth
II=not very smooth b) Discoloration of the bar soaps during extrusion
O=no discoloration
I=slight discoloration
II=distinct discoloration c) Creaminess of the foam
I=creamy foam
II=coarse foam d) Lime soap dispersion capacity (LSDC)
I=good
II=not very good The results are set out in Table 2:

TABLE 2

| Formulation | Smoothness | Discoloration | Creaminess | LSDC |
|---|---|---|---|---|
| | Performance results | | | |
| F1 | I | O | I | I |
| F2 | I | O | I | I |
| F3 | I | I | II | II |
| F4 | II | I | II | II |
| F5 | II | I | II | II |
| F6 | II | II | II | II |

LSDC = Lime soap dispersion capacity

The Examples according to the invention (formulations 1 and 2) and the Comparison Examples (formulations 3 and 6) show that the complex requirement profile—surface smoothness, no discoloration during production, creaminess of foam and high lime soap dispersion capacity—is achieved solely by the formulations according to the invention;

the addition of more than 1% by weight of alkyl glucoside leads to a sudden deterioration in the property profile;

the improvement in the property profile of the bar soaps is dependent on the nature of the anionic base surfactant.

We claim:

1. A bar soap comprising:

A) from about 70 to about 85% by weight of at least one fatty acid salt,

B) from about 0.5 to about 10% by weight of at least one fatty acid,

C) from about 1 to about 10% by weight of at least one alkyl ether sulfate, and

D) from about 0.5 to about 1% by weight of at least one of an alkyl oligoglycoside and an alkenyl oligoglycoside.

2. The bar soap of claim 1 wherein component A) is present in from about 73 to about 80% by weight, component B) is present in from about 2 to about 6% by weight, component C) is present in from about 2 to about 4% by weight, and component D) is present in from about 0.5 to about 1% by weight.

3. The bar soap of claim 1 in which component A) is at least one fatty acid salt of the formula:

$$R^1CO—ONa \quad (I)$$

in which $R^1CO$ is an aliphatic acyl radical containing from 6 to about 22 carbon atoms.

4. The bar soap of claim 3 in which component A) is a technical soap mixture based on at least one of a $C_{12-18}$ coconut oil fatty acid, a $C_{12-14}$ coconut oil fatty acid, or a tallow fatty acid.

5. The bar soap of claim 1 in which component B) is at least one fatty acid of the formula:

$$R^2CO—OH \quad (II)$$

in which $R^2CO$ is an aliphatic acyl radical containing from 6 to about 22 carbon atoms.

6. The bar soap of claim 5 in which component B) is at least one of a $C_{12-18}$ coconut oil fatty acid, a $C_{12-14}$ coconut oil fatty acid, or a $C_{16-18}$ tallow fatty acid.

7. The bar soap of claim 1 wherein component C) is at least one sulfate of an ethoxylated alcohol of the formula:

$$R^3O—(CH_2CH_2O)_nH \quad (III)$$

in which $R^3$ is a linear or branched alkyl or alkenyl radical containing 6 to 22 carbon atoms and n is a number of 1 to 10.

8. The bar soap of claim 7 in which component C) is at least one sulfate of an adduct of from 1 to 5 moles of ethylene oxide with 1 mole of a $C_{12/14}$ or $C_{12/18}$ coconut oil fatty alcohol.

9. The bar soap of claim 1 wherein component D) is at least one of an alkyl or alkenyl oligoglycoside of the formula:

$$R^4O—(G)_p \quad (IV)$$

in which $R^4$ is a linear or branched alkyl or alkenyl radical containing 6 to 22 carbon atoms, G is a sugar unit containing 5 or 6 carbon atoms and p is a number of from 1 to 10.

10. The bar soap of claim 9 wherein in formula IV, p is a number of from 1.1 to 3.0.

11. The bar soap of claim 10 wherein p is a number of from 1.2 to 1.4.

12. The bar soap of claim 9 wherein in formula IV, $R^4$ contains 6 to 11 carbon atoms.

13. The bar soap of claim 9 wherein in formula IV, $R^4$ is a primary alkyl group containing from 12 to 22 carbon atoms.

14. The bar soap of claim 1 which also contains a fine-particle, water-insoluble alkali metal aluminosilicate.

15. The bar soap of claim 1 in which component A) is at least one fatty acid salt of the formula:

$$R^1CO—ONa \quad (I)$$

in which $R^1CO$ is an aliphatic acyl radical containing from 6 to about 22 carbon atoms; component B) is at least one fatty acid of the formula:

$$R^2CO—OH \quad (II)$$

in which $R^2CO$ is an aliphatic acyl radical containing from 6 to about 22 carbon atoms; component C) is at least one sulfate of an ethoxylated alcohol of the formula:

$$R^3O—(CH_2CH_2O)_nH \quad (III)$$

in which $R^3$ is a linear or branched alkyl or alkenyl radical containing 6 to 22 carbon atoms and n is a number of 1 to 10; and component D) is at least one of an alkyl or alkenyl oligoglycoside of the formula:

$$R^4O—(G)_p \quad (IV)$$

in which $R^4$ is a linear or branched alkyl or alkenyl radical containing 6 to 22 carbon atoms, G is a sugar unit containing 5 or 6 carbon atoms and p is a number of from 1 to 10.

16. The bar soap of claim 15 wherein component A) is a technical soap mixture based on at least one of a $C_{12-18}$ coconut oil fatty acid, a $C_{12-14}$ coconut oil fatty acid, or a $C_{16-18}$ tallow fatty acid; component B) is at least one of a $C_{12-18}$ coconut oil fatty acid, a $C_{12-14}$ coconut oil fatty acid, or a $C_{16-18}$ tallow fatty acid; component C) is at least one sulfate of an adduct of from 1 to 5 moles of ethylene oxide with 1 mole of a $C_{12/14}$ or $C_{12/18}$ coconut oil fatty alcohol.

17. The bar soap of claim 15 wherein component A) is present in from about 73 to about 80% by weight, component B) is present in from about 2 to about 6% by weight, component C) is present in from about 2 to about 4% by weight, and component D) is present in from about 0.5 to about 1% by weight.

18. The bar soap of claim 15 wherein in component D) in formula IV, p is a number of from 1.1 to 3.0.

19. The bar soap of claim 18 wherein p is a number of from 1.2 to 1.4.

20. The bar soap of claim 18 wherein in formula IV, $R^4$ is an alkyl group containing 6 to 11 carbon atoms, or a primary alkyl group containing from 12 to 22 carbon atoms.

* * * * *